US008702395B2

(12) United States Patent
Gearhart

(10) Patent No.: US 8,702,395 B2
(45) Date of Patent: Apr. 22, 2014

(54) HUB FIN DEVICE

(75) Inventor: Walter S. Gearhart, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 427 days.

(21) Appl. No.: 13/122,167

(22) PCT Filed: Sep. 10, 2009

(86) PCT No.: PCT/US2009/056522
§ 371 (c)(1),
(2), (4) Date: Apr. 1, 2011

(87) PCT Pub. No.: WO2010/044966
PCT Pub. Date: Apr. 22, 2010

(65) Prior Publication Data

US 2011/0182747 A1 Jul. 28, 2011

Related U.S. Application Data

(60) Provisional application No. 61/105,820, filed on Oct. 16, 2008.

(51) Int. Cl.
*B63H 1/26* (2006.01)

(52) U.S. Cl.
USPC ..... 416/203; 416/239

(58) Field of Classification Search
USPC ..... 416/175, 203, 227 A, 239, 245 A, 247 A, 416/244 B
See application file for complete search history.

(56) References Cited

U.S. PATENT DOCUMENTS

| | | | | |
|---|---|---|---|---|
| 3,514,215 | A * | 5/1970 | Williams | 416/200 R |
| 5,791,874 | A * | 8/1998 | Lang | 416/62 |
| 6,390,776 | B1 * | 5/2002 | Gruenwald | 416/203 |
| 6,699,016 | B1 * | 3/2004 | Dean | 416/235 |

FOREIGN PATENT DOCUMENTS

| | | | |
|---|---|---|---|
| EP | 40645 | A1 * | 12/1981 |
| JP | 03079493 | A * | 4/1991 |
| JP | 06298176 | A * | 10/1994 |

OTHER PUBLICATIONS

JP 6-298176 A Machine Translation. Accessed JPO website Aug. 7, 2013. 2 Pages.*

* cited by examiner

*Primary Examiner* — Richard Edgar
(74) *Attorney, Agent, or Firm* — Gifford, Krass, Sprinkle, Anderson & Citkowski, P.C.

(57) ABSTRACT

The present invention discloses a hub fin device for improving the efficiency of a propeller. The hub fin device can include a propeller having a hub and a plurality of propeller blades that extend radially outward from the hub. Each of the plurality of propeller blades has a trailing edge region. A fin can also be included and located in the trailing edge region of at least one of the plurality of propeller blades. The fin extends radially outward from the hub and reduces or eliminates a hub vortex that is normally present during operation of the propeller.

5 Claims, 3 Drawing Sheets

HUB FIN DEVICE

CROSS-REFERENCE TO RELATED APPLICATION

This application is the U.S. national phase of PCT/US2009/056522 filed Sep. 10, 2009, which claims priority of U.S. Provisional Patent Application Ser. No. 61/105,820 filed Oct. 16, 2008, entitled "Hub Fin Device", which is incorporated in its entirety herein by reference.

FIELD OF THE INVENTION

The present invention is related to a hub fin device for improving the efficiency of a propeller. In particular, the hub fin device has one or more fins located in a trailing edge region of at least one of the propeller blades of the propeller.

BACKGROUND OF THE INVENTION

Propellers are the most common source of propulsion for boats, ships, etc., and typically include a central hub with blades in the form of helicoidal surfaces that are attached to and extend outwardly from the hub. The propeller is commonly attached to a shaft that is either directly or indirectly attached to a motor, the motor operable to drive or rotate the shaft. Upon rotation of the shaft, and thus rotation of the propeller, the blades act to "screw" through the water and impart momentum to a fluid, e.g. water, in which the propeller is located and thereby apply a force to act on the boat, ship and the like. A propeller that turns clockwise to produce forward thrust when viewed from the aft is known as a right-handed propeller and one that turns counterclockwise a left-handed propeller.

Rotation of the propeller can also produce a low pressure region formed by fluidic velocity of circumferential flows and the low pressure region can form a vapor cavity known as a hub vortex. The hub vortex can cause a reduction in shaft thrust and an overall decrease in efficiency of a boat or ship propulsion system. While efforts have been made to reduce the hub vortex produced by a given propeller, such efforts have resulted in complex and costly additions to the ship propeller. For example, a propeller boss cap with fins (PBCF) is a boss cap that is attached to a hub or "boss" of a ship propeller and has the same number of fins as the blades of the propeller. The PBCF rotates with the propeller and the fins rectify water flow around the propeller boss to reduce and/or eliminate the hub vortex. As such, an improved propeller that reduces hub vortex without significantly increasing the complexity and cost of the overall propulsion system would be desirable.

SUMMARY OF THE INVENTION

The present invention discloses a hub fin device for improving the efficiency of a propeller. The hub fin device can include a propeller having a hub with a plurality of propeller blades that extend radially outward from the hub. Each of the plurality of propeller blades has a leading edge, a trailing edge and a trailing edge region proximate to the trailing edge. A fin can also be included and located in the trailing edge region of at least one of the plurality of propeller blades. The fin extends radially outward from the hub and reduces or eliminates a hub vortex that is normally present during operation and/or rotation of the propeller.

The fin can extend from a trailing edge of at least one of the plurality of propeller blades, or in the alternative, can be located generally midway between two adjacent propeller blades. In some instances, the hub fin device can include a plurality of fins with each of the fins located in the trailing edge region. One or more of the fins can be integral with the hub, or in the alternative, one or more of the fins can be separately attached to the hub. If one of the fins is attached to the hub, it can be attached using an adhesive, a clamp, a weld, a threaded fastener, a tongue-and-groove type fitting, and the like. In addition, the plurality of fins can be retrofitted to an existing propeller that may or may not have been in operation and may or may not still be attached to a boat, ship and the like.

If a plurality of fins are provided, each of the plurality of fins can extend from a trailing edge of the propeller blades, be located generally midway between adjacent propeller blades, or be a combination thereof with at least one of the fins extending from the trailing edge of one of the propeller blades and at least one of the fins being located generally between two adjacent propeller blades.

DETAILED DESCRIPTION OF THE INVENTION

The present invention discloses a propeller with a fin that extends from a hub, also known as a boss, the fin reducing or eliminating a hub vortex during operation and/or rotation of the propeller. In some instances, a plurality of fins can be included and the number of fins can equal or exceed the number of blades on the propeller. The fin can be integral with the propeller or can be retrofitted onto an existing propeller.

The fin can be located in a trailing edge portion of the propeller which is proximate to a trailing edge of a propeller blade. In some instances, the fin is spaced apart from a proximate propeller blade and may or may not be located generally midway between two adjacent blades, while in other instances the fin is located directly adjacent to a blade and can extend from and/or beyond a trailing edge of the blade. It is appreciated that if a propeller has, for example, three blades, then three fins can be included such that a fin is located between and is spaced apart from each pair of adjacent blades. In the alternative, a fin can extend from the trailing edge of each propeller blade. In still another alternative, one or more fins can be located in the trailing edge region that is between two adjacent blades and one or more fins can extend from the trailing edge.

The fins can reduce or eliminate circumferential flow of water proximate to the hub and thereby afford for the reduction or elimination of the hub vortex produced by the propeller. As such, the present invention has utility as a component for a propeller.

The hub fin device can be used with fixed pitch propeller (FPP) or a variable/controllable pitch propeller (VPP). It is appreciated that the VPP is a propeller that has individual blades that are each mounted on a circular spindle or pedestal. The spindle is embedded in the propeller hub and is capable of being rotated to change the orientation/pitch of the propeller blade by rotating the blade about its long axis. The pitch can be set to negative values and thus afford for a reversible propeller that can create reverse thrust for braking or going backwards without the need of changing the rotational direction of the propeller shaft. In addition, the VPP can provide the highest propulsive efficiency for a range or combination of speeds and loads of the ship and not just one speed/load combination as for the FPP.

Given the variable pitch of the VPP blades, the hub fin device can have a fin that is attached to the blade and/or the circular spindle supporting the blade. In the alternative, the fin could be fabricated as an integral part of the propeller blade and/or spindle. In either configuration, the fin would rotate with the propeller blade when its pitch is altered.

Figure 1:
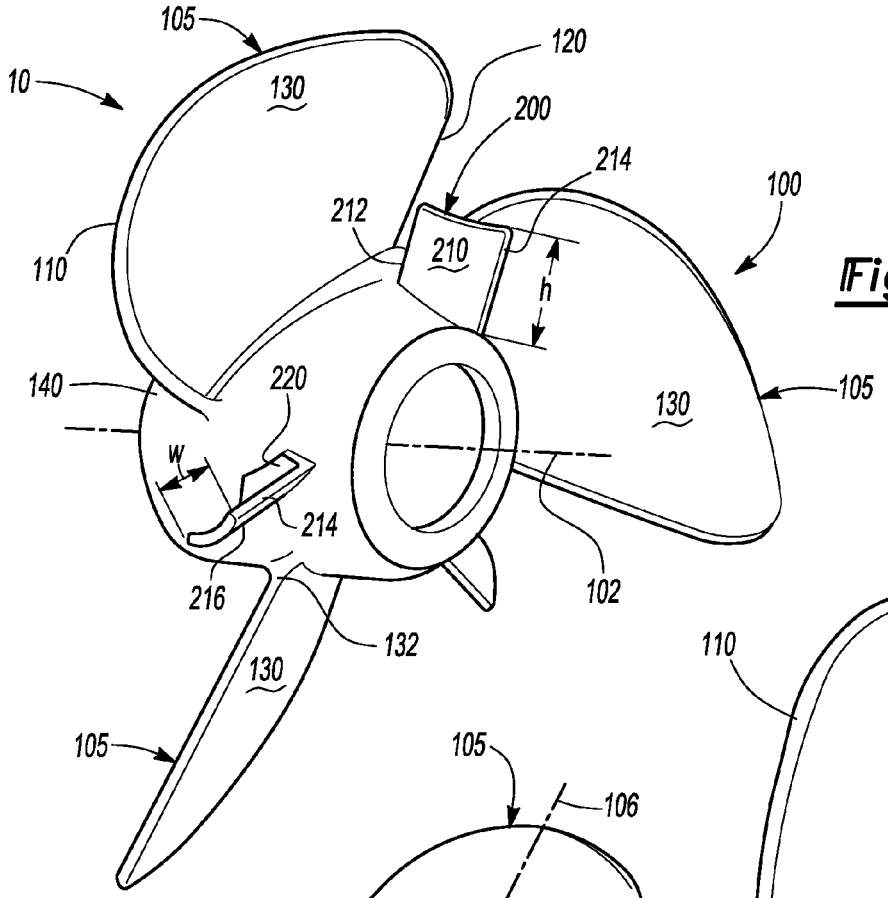
FIG. 1 is a perspective view of an embodiment of the present invention.
Figure 2:
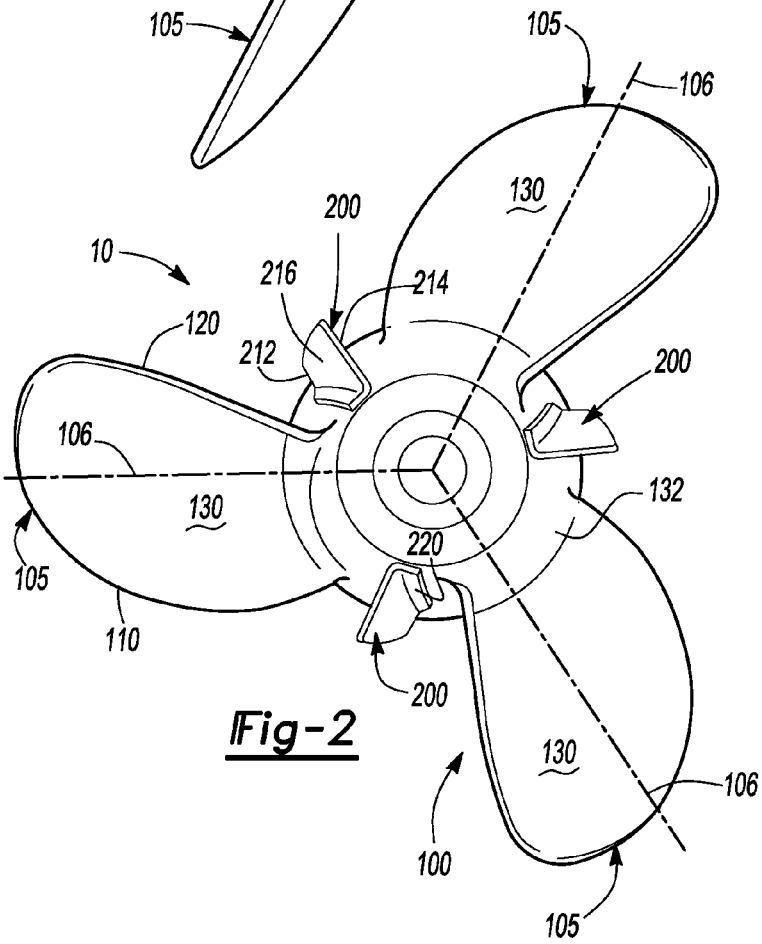
FIG. 2 is a rear view of the embodiment shown in FIG. 1.
Figure 3:
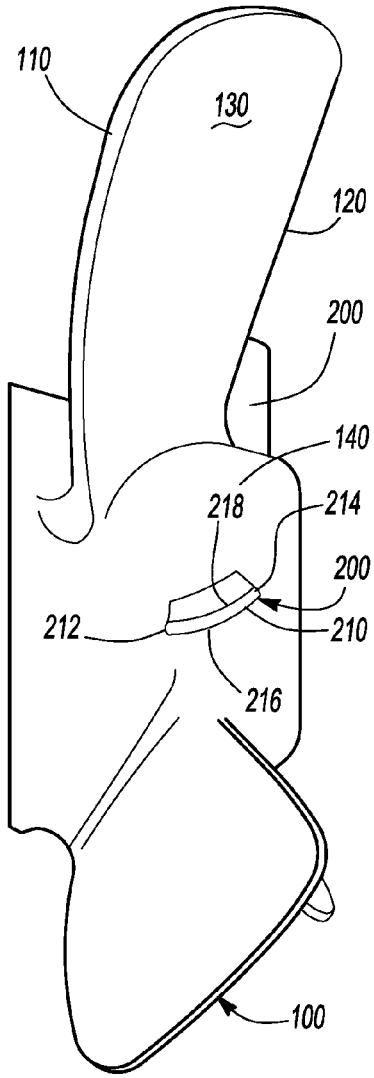
FIG. 3 is a side view of the embodiment shown in FIG. 1

Looking now to FIGS. 1-3, a propeller having a fin in accordance with an embodiment of the present invention is shown generally at reference numeral 10. The embodiment 10 includes a propeller 100, the propeller 100 having a central axis 102 and at least one blade 105. It is appreciated that the propeller 100 can be a FPP, or in the alternative, a VPP with the blade 105 operable to rotate about a long axis 106.

The blade 105 can have a leading edge 110, a trailing edge 120 and a blade surface 130 extending between the leading edge 110 and trailing edge 120. The blade 105 is attached to a hub or boss 140 at a web region 132 and extends radially outward from the hub 140. It is appreciated that the configuration of the at least one blade 105 on the hub 140 as shown in FIGS. 1-3 corresponds to a left-handed propeller. It is further appreciated that the hub fin device disclosed can be used with or attached to a right-handed propeller.

Located between adjacent propeller blades 105 is a fin 200. The fin 200 can be spaced apart from the blades 105 and can include a blade portion 210 and an optional support portion 220. The blade portion 210 extends in a radially outward direction from the hub 140. The blade portion 210 includes a leading edge 212 and a trailing edge 214. In addition, extending between the leading edge 212 and the trailing edge 214 are oppositely disposed aft surface 216 and bow surface 218. The blade portion 210 can have a height "h" and a width "w". In some instances, the height h of the blade portion 210 and the overall height of the propeller blade 105 can have a ratio of between 0.15 and 0.35, inclusive, while in other instances the ratio can be between 0.2 and 0.3. In addition, the width w of the blade portion 210 and the overall width of the propeller blade 105 can have a ratio of between 0.25 and 0.50, inclusive, or in the alternative the ratio can be between 0.3 and 0.4. Regarding the blade portion 210, in some instances the concavity of the blade surface of the blade portion 210 can be opposite to the concavity associated with the blade surface 130.

Figure 4:
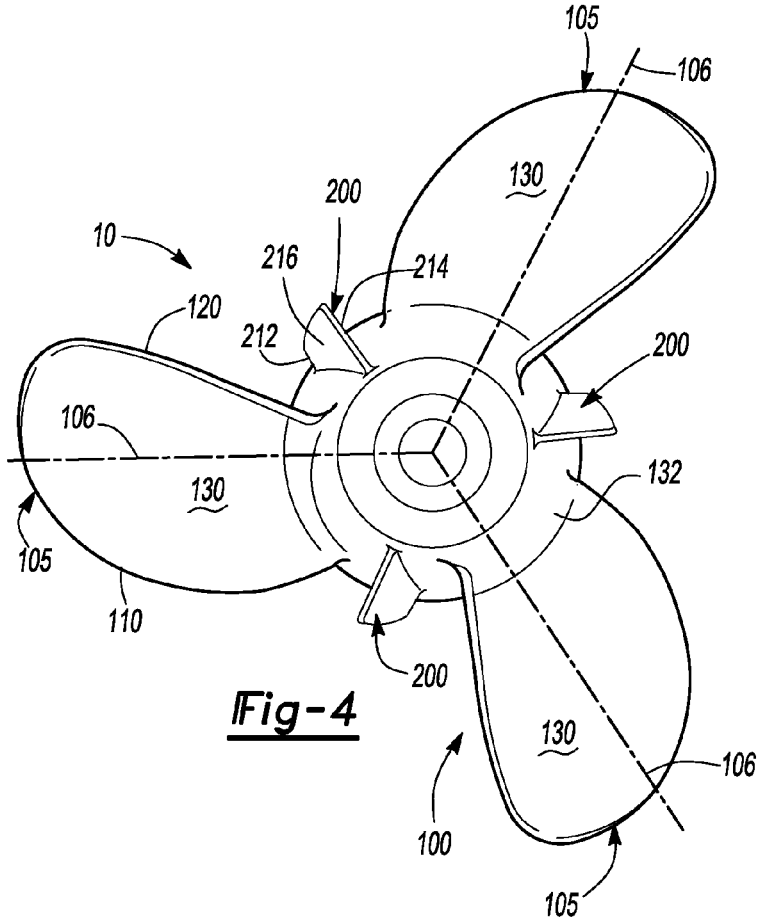
FIG. 4 is a perspective view of the embodiment shown in FIG. 1 with fins integral with a propeller hub.

The fin 200 can be integral with the hub 140 as shown in FIG. 4, e.g. be formed as part of a propeller casting, or in the alternative, the optional support portion 220 can be used to separately attach the fin 200 to the hub 140. For the purposes of the present invention, the term "separately attach" is defined to mean that the fin is not integral with the hub and/or propeller blade and it must be attached to the propeller using an additional device and/or material. For example and for illustrative purposes only, the optional support portion 220 can have at least one aperture (not shown) through which a threaded fastener can be used to attach the fin 200 to the hub 140. In the alternative, the fin 200 can be welded to the hub 140, with the optional support portion 220 providing additional perimeter about which a weld can be located. It is appreciated that other methods or devices can be used to rigidly attach the fin 200 to the hub 140, illustratively including adhesives, clamps, clips, tongue-and-groove type fittings and the like.

Figure 5:
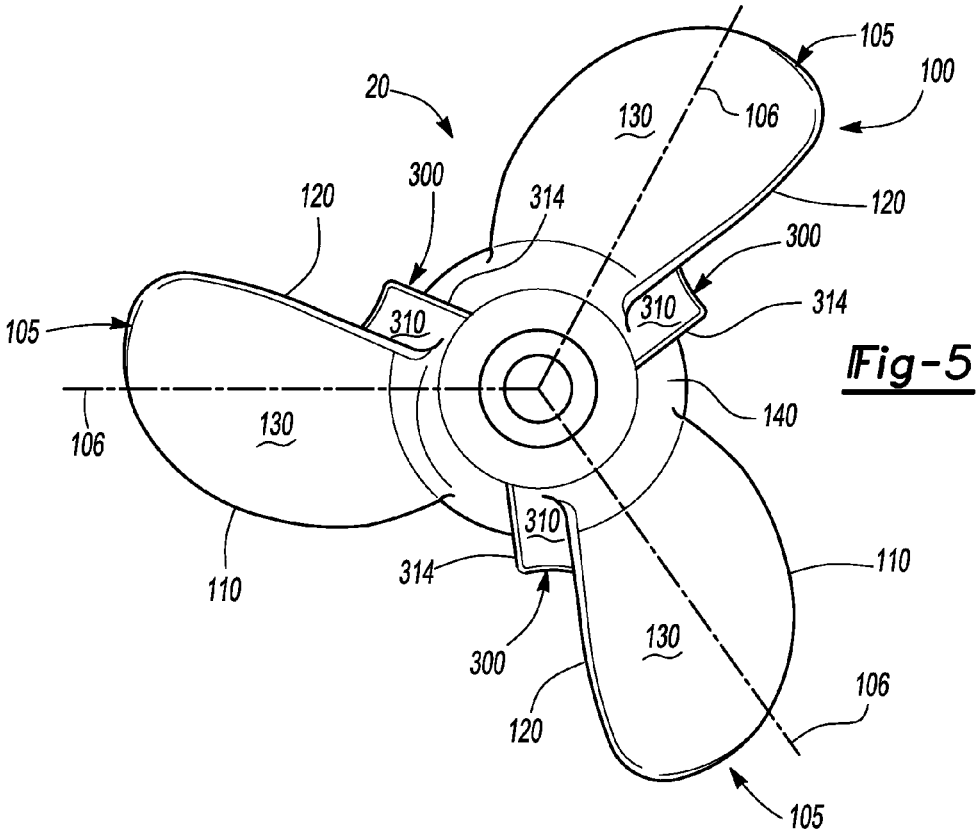
FIG. 5 is a rear view of another embodiment of the present invention.
Figure 6:
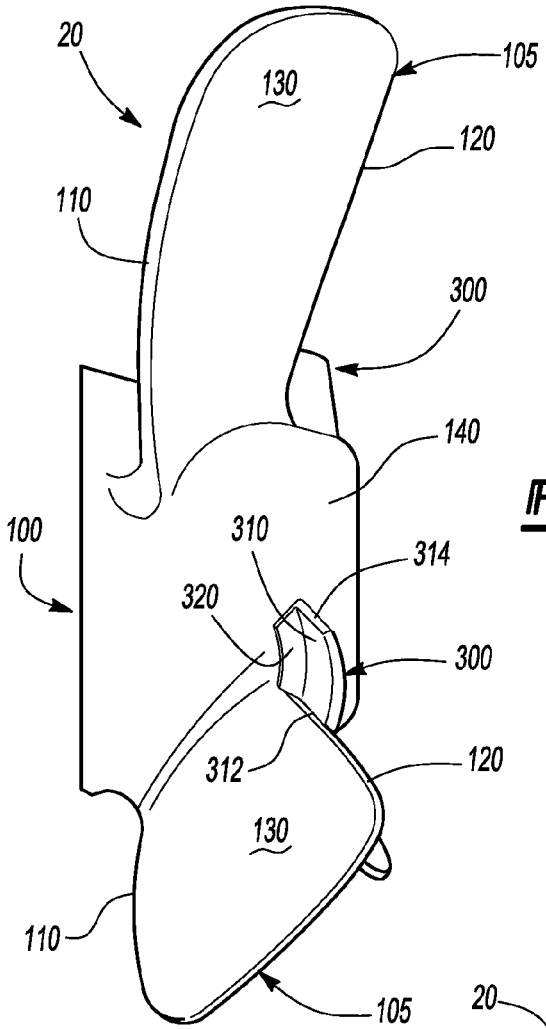
FIG. 6 is a side view of the embodiment shown in FIG. 5.
Figure 7:
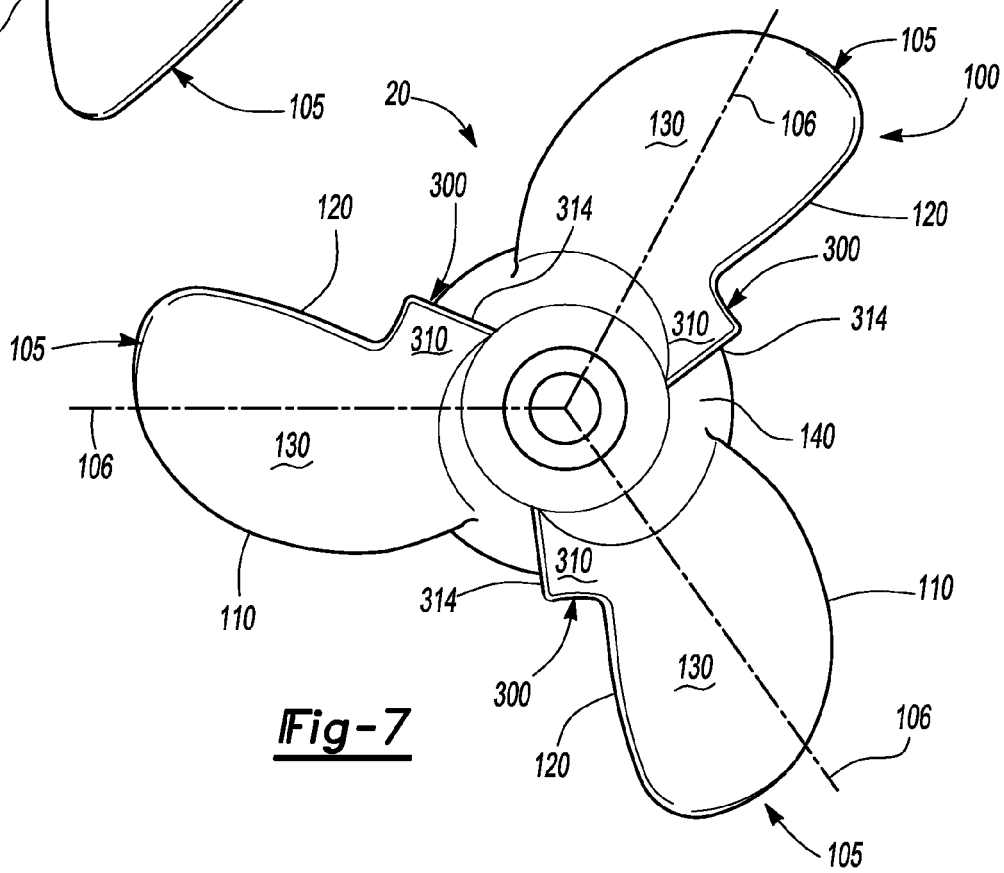
FIG. 7 is a side view of the embodiment shown in FIG. 6 with fins integral with blades of a propeller.

Turning now to FIGS. 5-7, another embodiment is shown generally at reference numeral 20, the embodiment 20 also having a propeller 100 with a fin 300 attached to the hub 140. The fin 300 can be located directly adjacent or next to the blade 105 and extends beyond the trailing edge 120. The fin 300 has a blade portion 310 and an optional support portion 320, the blade portion 310 extending from or beyond the trailing edge 120 of the blade 105 to a trailing edge 314. Similar to the embodiment 10 shown in FIGS. 1-4, the fin 300 can be integral with the hub 140 and/or blade 105 as shown in FIG. 7, or in the alternative, the support portion 320 can be used to attach the fin 300 to the hub 140 using threaded fasteners, welding, adhesives, clamps, clips, tongue-and-groove type fittings and the like.

It is appreciated that if the propeller 100 is a VPP, it can be desirous for the fin 300 to be separately attached only to, or integral only with, the blade 105 and/or a spindle (not shown) to which the blade is attached. For example and for illustrative purposes only, FIG. 7 can illustrate a VPP (spindle not shown) where the blades 105 can rotate about the long axis 106 and the fins 300 can rotate with the blades 105 when their pitch is altered. The fin can be separately attached to the VPP blade and/or the spindle, or in the alternative, manufactured integrally with the VPP blade and/or spindle. With the fin attached to or integral with the VPP blade and/or spindle, a number of advantages are provided relative to a standard VPP and/or a PBCF. For example, the leading edge of the fin can be aligned with fluid flow past the VPP blade, independent of the VPP blade pitch. This is in contrast to fins mounted on the propeller cap or tail cone, e.g. fins associated with a PBCF, which can experience off-design flow.

As stated above, in the alternative to attaching a fin 200 or a fin 300 to an existing propeller 100, a propeller can be manufactured such that the hub fin is integral therewith (FIGS. 4 and 7). For example, a propeller can be cast or machined such that it includes the fin(s) 200 and/or the fin(s) 300. The fin included as an integral portion of the propeller blade as well as the fin retrofitted and located directly adjacent or next to the propeller blade can provide at least two advantages. One advantage can be that proper alignment of the leading edge of a fin is not a concern since it is adjacent or imbedded in the blade trailing edge. Another advantage can be that absence of a fin leading edge can provide an anti-fouling feature. It is appreciated from FIGS. 4-7 that a fin located directly adjacent or next to the propeller blade refers to the fin being up against the blade, i.e. there is no space between a leading edge of the fin and a trailing edge of the propeller blade. Stated differently, the fin is not spaced apart from the propeller blade.

During operation, the fin 200 and/or fin 300 reduces or prevents liquid from the aft side of the blade 105 that is passing or "coming off" the trailing edge 120 of a propeller blade 105 from circumferentially overturning. Both radial and transverse flows exist in the blade passage near the hub 140 which results in a circumferential overturning of the fluid in this region. This overturning generates the hub vortex and the hub fin device can reduce this overturning. In this manner, a propeller is provided that reduces or eliminates the hub vortex that is typically created during operation and/or rotation of the propeller. In addition, the ability to retrofit an existing propeller with a hub fin device as disclosed herein provides for a simple yet effective manner to increase shaft thrust and reduce shaft torque, thereby improving propulsion system efficiency.

The hub fin device can be made from any material known to those skilled in the art, illustratively including materials that are identical, similar or dissimilar to the propeller materials such as aluminum, brass, steels, stainless steels, high alloy materials, high strength plastics and the like. The invention is not restricted to the illustrative examples and embodiments described above and the examples and embodiments are not intended as limitations on the scope of the invention. Methods, apparatus, compositions and the like described herein are exemplary and not intended as limitations on the scope of the invention.

I claim:

1. A hub fin device for improving the efficiency by reducing or eliminating hub vortex of a propeller, said hub fin device comprising:

a propeller having a hub and a plurality of propeller blades extending radially outward from said hub, each of said plurality of propeller blades having an overall height, a trailing edge and a trailing edge region; and a plurality of fins with a separate fin located directly adjacent to said trailing edge in said trailing edge region of each of said plurality of propeller blades, each of said fins integral with or directly attached to and extending radially outward from said hub, each of said fins having a blade portion with a height;

each of said propeller blades and each of said fins dimensioned such that a ratio of said height of said fin blade portion to said overall height of said propeller blade is between 0.15-0.35, inclusive.

2. The hub fin device of claim 1, wherein each of said fins have a fin concavity and each of said propeller blades have a blade concavity, said fin concavity being opposite to said blade concavity.

3. The hub fin device of claim 2, wherein each of said fins is integral with said respective propeller blade that each fin is located directly adjacent to.

4. A hub fin device for improving the efficiency by reducing or eliminating hub vortex of a propeller, said hub fin device comprising:

a propeller having a hub and a plurality of propeller blades extending radially outward from said hub, each of said plurality of propeller blades having an overall height, a trailing edge and a trailing edge region; and a plurality of fins with a separate fin located directly adjacent to said trailing edge in said trailing edge region of each of said plurality of propeller blades, each of said fins directly attached to and extending radially outward from said hub, each of said fins having a blade portion with a height;

wherein said at least one of said fins is directly attached to said hub using an attachment mechanism, said attachment mechanism selected from the group consisting of an adhesive, a clamp, a weld, a threaded fastener, a tongue-and-groove type fitting;

each of said propeller blades and each of said fins dimensioned such that a ratio of said height of said fin blade portion to said overall height of said propeller blade is between 0.15-0.35, inclusive.

5. The hub fin device of claim 4, wherein said plurality of fins are retrofitted to an existing propeller.

* * * * *